US008102220B2

(12) United States Patent
Kawanami

(10) Patent No.: US 8,102,220 B2
(45) Date of Patent: Jan. 24, 2012

(54) NON-RECIPROCAL CIRCUIT DEVICE

(75) Inventor: Takashi Kawanami, Oumihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 285 days.

(21) Appl. No.: 12/633,852

(22) Filed: Dec. 9, 2009

(65) Prior Publication Data

US 2010/0156551 A1 Jun. 24, 2010

(30) Foreign Application Priority Data

Dec. 19, 2008 (JP) ..... 2008-323533

(51) Int. Cl.
*H01P 1/36* (2006.01)

(52) U.S. Cl. ..... 333/24.2

(58) Field of Classification Search ..... 333/1.1, 333/24.2

See application file for complete search history.

(56) References Cited

U.S. PATENT DOCUMENTS 7,253,697 B2 * 8/2007 Soda et al. ..... 333/24.2
2002/0079981 A1 6/2002 Tanaka
2004/0263278 A1 12/2004 Hino
2007/0236304 A1 10/2007 Kawanami

FOREIGN PATENT DOCUMENTS

JP 2002-076711 A 3/2002
JP 2005-020195 A 1/2005
JP 4003650 B2 11/2007
WO 2007/046229 A1 4/2007

* cited by examiner

*Primary Examiner* — Stephen Jones
(74) *Attorney, Agent, or Firm* — Keating & Bennett, LLP

(57) ABSTRACT

A non-reciprocal circuit device includes a ferrite arranged to receive a direct-current magnetic field from a permanent magnet, a first central electrode and a second central electrode arranged on the ferrite. The non-reciprocal circuit device further includes matching capacitors and a terminating resistor. When high frequency signals flow in a reverse direction, power consumption at the first central electrode is increased by decreasing an equivalent parallel resistance Rp of the first central electrode, in relation to power consumption at the terminating resistor.

10 Claims, 10 Drawing Sheets

NON-RECIPROCAL CIRCUIT DEVICE

BACKGROUND OF THE INVENTION

1. Field of the Invention

The present invention relates to a non-reciprocal circuit device and, in particular, to a non-reciprocal circuit device, such as an isolator or a circulator, used in microwave bands.

2. Description of the Related Art

A non-reciprocal circuit device, such as an isolator or a circulator, has characteristics that allow transmission of a signal in a predetermined direction but not in a reverse direction. Because of these characteristics, for example, an isolator is used in a transmitter circuit of a mobile communication device, such as an automobile telephone or a cellular phone, for example.

To reduce insertion loss, International Publication No. 2007/046229 describes a 2-port isolator that includes a first central electrode and a second central electrode that arranged on the ferrite so as to cross each other and so as to be electrically insulated from each other. A terminating resistor, which is arranged in parallel with the first central electrode and connected between an input port and an output port, is built in the circuit board. High frequency signals traveling in a reverse direction generate heat that is dissipated at the terminating resistor. If the terminating resistor does not adequately radiate heat, the electrical characteristics of the isolator deteriorate due to the increased temperature. Therefore, in order to avoid overheating, the terminating resistor must adequately radiate heat.

A non-reciprocal circuit device disclosed Japanese Patent 4003650 addresses the heat radiation of a terminating resistor. The non-reciprocal circuit device according to Japanese Patent 4003650 ensures adequate heat radiation by providing a via-hole in the dielectric substrate. Conventionally, improving a power handling capability by improving the heat radiation ability of the terminating resistor primarily depends on the power consumption of the terminating resistor. However, in the non-reciprocal circuit device disclosed in Japanese Patent 4003650 heat is still primarily generated at the terminating resistor.

SUMMARY OF THE INVENTION

To overcome the problems described above, preferred embodiments of the present invention provide a non-reciprocal circuit device that decreases heat that is generated at a terminating resistor and prevents deterioration of the electrical characteristics.

A non-reciprocal circuit device according to a preferred embodiment of the present invention includes a permanent magnet, a ferrite arranged to receive a direct-current magnetic field from the permanent magnet, a first central electrode and a second central electrode arranged on the ferrite so as to cross each other and so as to be electrically insulated from each other, a first end of the first central electrode is electrically connected to an input port and a second end of the first central electrode is electrically connected to an output port, a first end of the second central electrode is electrically connected to the output port and a second end of the second central electrode is electrically connected to a ground port, a first matching capacitor is electrically connected between the input port and the output port, a second matching capacitor is electrically connected between the output port and the ground port, and a resistor is electrically connected between the input port and the output port, wherein an equivalent parallel resistance of the first central electrode is decreased such that, while signals flow in a reverse direction, power consumed at the first central electrode is greater than power consumed at the terminating resistor.

With the non-reciprocal circuit device according to this preferred embodiment, when signals flow in the reverse direction, the power of the signals is consumed not only at the terminating resistor but also at the first central electrode. Accordingly, heat is generated at a plurality of different portions so as to effectively disperse the heat, the withstand voltage characteristic is improved, and burnout of the terminating resistor is prevented. In addition, a smaller terminating resistor can be utilized, and the non-reciprocal circuit device itself can be provided with a smaller size by having an increased heat radiation path. Furthermore, since a temperature increase at the terminating resistor is reduced, variations in the resistance of the terminating resistor due to the heat generation are decreased and deterioration of the isolation characteristics thereof is prevented. In a 2-port type isolator which includes a second central electrode that is wound multiple turns around the ferrite to achieve a low insertion loss, a terminating resistor having a relatively high resistance of about 100Ω to about 500Ω, for example, is utilized. Since the power consumption of high frequency signals which flow in a reverse direction is dispersed between the terminating resistor and the first central electrode, preferable electrical characteristics are maintained.

According to a preferred embodiment of the present invention, since the power is consumed at the terminating resistor and at the first central electrode, heat generation at the terminating resistor is reduced such that the electrical characteristics are not deteriorated and the size of the non-reciprocal circuit device can be reduced.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

A non-reciprocal circuit device according to a first preferred embodiment of the present invention will now be described below with reference to the accompanying drawings.

Figure 1:
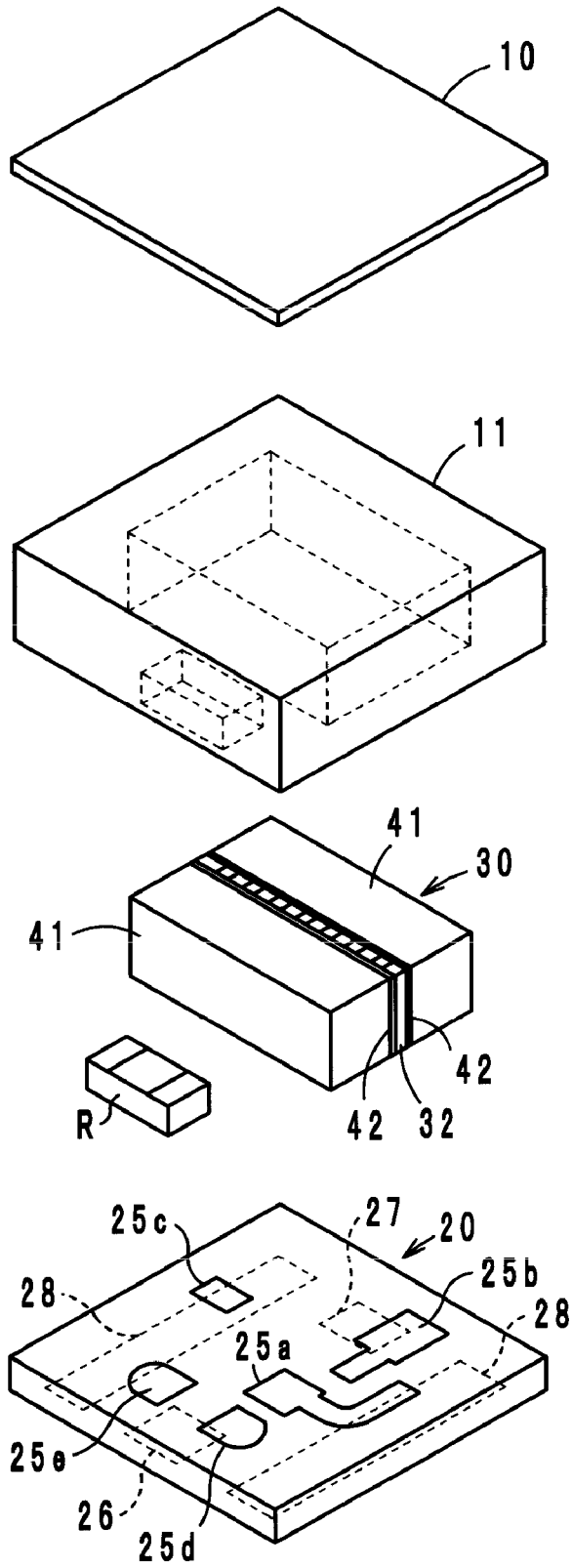
FIG. 1 is an exploded perspective view illustrating a non-reciprocal circuit device according to a first preferred embodiment of the present invention.

FIG. 1 shows an exploded perspective view of a 2-port type isolator according to a first preferred embodiment of the present invention. The 2-port type isolator is preferably a lumped constant type isolator, which preferably includes a tabular yoke 10, a circuit board 20, a ferrite-magnet assembly 30 which includes a ferrite 32 and a pair of permanent magnets 41.

Figure 2:
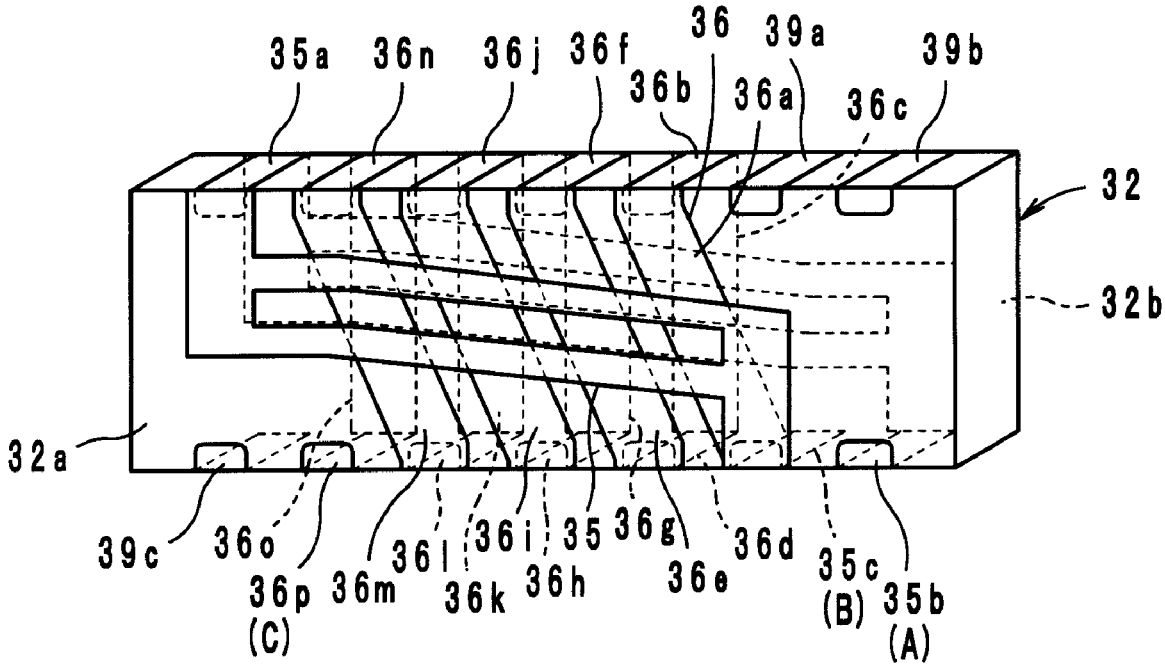
FIG. 2 is a perspective view illustrating a ferrite with a central electrode.

As shown in FIG. 2, a first central electrode 35 and a second central electrode 36, which are electrically insulated from one another, are arranged on front and back main surfaces 32*a* and 32*b* of the ferrite 32. The ferrite 32 preferably has a substantially rectangular parallelepiped shape having the first main surface 32*a* and the second main surface 32*b* arranged parallel or substantially parallel to each other, for example.

The permanent magnets 41 are bonded to the main surfaces 32*a* and 32*b* of the ferrite 32, using an epoxy based adhesive agent 42 (see FIG. 4), for example, so that a magnetic field is applied to be substantially perpendicular to the main surfaces 32*a* and 32*b*. Thus, a ferrite-magnet assembly 30 is provided. The main surfaces 41*a* of the permanent magnets 41 preferably have the same or substantially the same dimensions as the main surfaces 32*a* and 32*b* of the ferrite, and are mounted with the main surfaces 32*a* and 41*a*, and the main surfaces 32*b* and 41*a*, facing each other so that the peripheries of the main surfaces 32*a* and 41*a* and the main surfaces 32*b* and 41*b* are aligned or substantially aligned.

The first central electrode 35 preferably includes a conductive film. That is, as shown in FIG. 2, the first central electrode 35 extends on the first main surface 32*a* of the ferrite 32, rising from the lower right portion of the first main surface 32*a*, and being bifurcated into two lines in the middle portion thereof. Thus, the first central electrode 35 is inclined at a relatively small angle with respect to the long side of the first main surface 32*a* to the upper left portion of the ferrite 32. The first central electrode 35 rises to the upper left portion of the first main surface 32*a*, and is then routed to the second main surface 32*b* via a relay electrode 35*a* on the top surface 32*c*. The first central electrode 35 then extends on the second main surface 32*b*, and is bifurcated into two lines in the middle portion thereof, such that the extended portion of the first central electrode 35 on the first main surface 32*a* and the extended portion thereof on the second main surface 32*b* oppose each other with the ferrite 32 disposed therebetween. One end of the first central electrode 35 is connected to a connection electrode 35*b* located on the bottom surface 32*d* of the ferrite 32. The other end of the first central electrode 35 is connected to a connection electrode 35*c* located on the bottom surface 32*d* of the ferrite 23. In this manner, the first central electrode 35 is wound around the ferrite 32 by one turn. The first central electrode 35 crosses the second central electrode 36 (described in more detail below) with an insulator layer interposed therebetween in an electrically insulated manner.

The second central electrode 36 preferably includes a conductive film. The second central electrode 36 includes a 0.5-turn second central electrode 36*a* that extends from the lower side to the upper side of the first main surface 32*a* at a relatively large angle with respect to the long side of the first main surface 32*a*, such that the second central electrode 36*a* crosses the first central electrode 35. The second central electrode 36*a* extends via a relay electrode 36*b* on the top surface 32*c* of the ferrite 32 to the second main surface 32*b* of the ferrite, and then a 1-turn second central electrode 36*c* extends substantially vertically, crossing the first central electrode 35. The lower portion of the 1-turn second central electrode 36*c* extends to the first main surface 32*a* via a relay electrode 36*d* on the bottom surface 32*d* of the ferrite 32. A 1.5-turn second central electrode 36*e* extends in parallel or substantially in parallel with the 0.5-turn second central electrode 36*a* on the first main surface 32*a* such that the 1.5-turn second central electrode 36*e* crosses the first central electrode 35. The 1.5-turn second central electrode 36*e* then extends to the second main surface 32*b* via a relay electrode 36*f* on the top surface 32*c* of the ferrite 32. Similarly, a 2-turn second central electrode 36*g*, a relay electrode 36*h*, a 2.5-turn second central electrode 36*i*, a relay electrode 36*j*, a 3-turn second central electrode 36*k*, a relay electrode 36*l*, a 3.5-turn second central electrode 36*m*, a relay electrode 36*n*, and a 4-turn second central electrode 36*o* are successively provided on the surfaces of the ferrite 32. Both ends of the second central electrode 36 are respectively connected to the connection electrodes 35*c* and 36*p* located on the bottom surface 32*d* of the ferrite 32. It is noted that the first central electrode 35 and the second central electrode 36 respectively share the connection electrode 35*c* as the terminal connection electrodes thereof.

Accordingly, the second central electrode 36 is wound around the ferrite 32 preferably by four turns, for example. Here, the number of turn is counted as 0.5 turn when the central electrode 36 intersects either the first main surface 32*a* or the second main surface 32*b* once. A crossing angle between the central electrodes 35 and 36 is set as required, and an input impedance and an insertion loss are adjusted.

Figure 3:
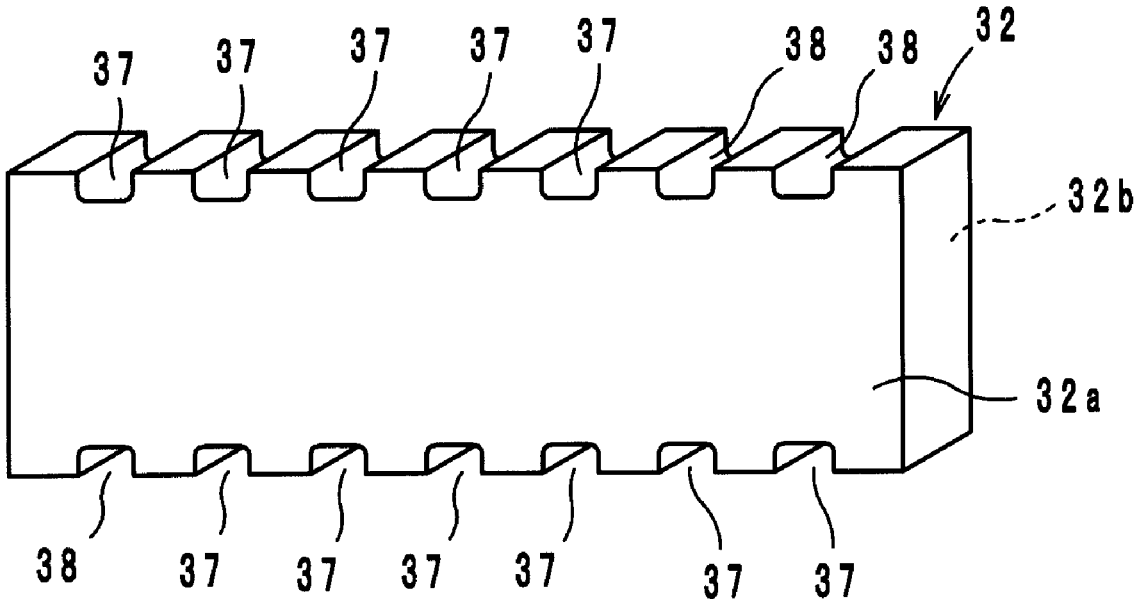
FIG. 3 is a perspective view illustrating the ferrite element.

The connection electrodes 35*b*, 35*c*, and 36*p* and the relay electrodes 35*a*, 36*b*, 36*d*, 36*f*, 36*h*, 36*j*, 361, and 36*n* are formed preferably by applying or filling cutout portions 37 (see FIG. 3) provided on the top and bottom surfaces 32*c* and 32*d* of the ferrite 32 with conductive material, such as silver, silver-based alloy, copper or copper-based alloy, for example. Dummy cutout portions 38 are provided on the top surface 32*c* and 32*d* in parallel or substantially in parallel with electrodes and dummy electrodes 39*a*, 39*b* and 39*c* are provided thereby. These types of electrodes are preferably formed as described below. Through-holes are formed in a mother ferrite board, and the through-holes are filled with conductive material. The mother ferrite board is then cut along a line that divides the through-holes. The electrodes may also be defined by a conductor layer deposited in the cutout portions 37 and 38.

YIG ferrite is preferably used for the ferrite 32, for example. The first and second central electrodes 35 and 36 and the other electrodes are preferably defined by a thick film or a thin film of silver or a silver-based alloy using printing, transfer printing, or photolithographic printing technique, for example. The insulator layer for the central electrodes 35 and 36 may preferably be a dielectric thick film made of glass or alumina, or a resin film made of polyimide, for example. The insulator layer may also be produced using printing, transfer printing, or photolithographic printing technique, for example.

The ferrite 32 composed of magnetic material can be produced by co-firing with the insulator layer and the various electrodes. In such a case, an electrode material, such as Cu, Ag, Pd, or Ag/Pd, for example, which can withstand a high firing temperature is preferably used.

The permanent magnet 41 is preferably a strontium-based ferrite magnet, a barium-based ferrite magnet, or a lanthanum-cobalt based ferrite magnet, for example. As an adhesive agent 42 for bonding the permanent magnet 41 to the ferrite 32, a thermo-setting one-component epoxy resin, for example, is preferred.

Figure 5:
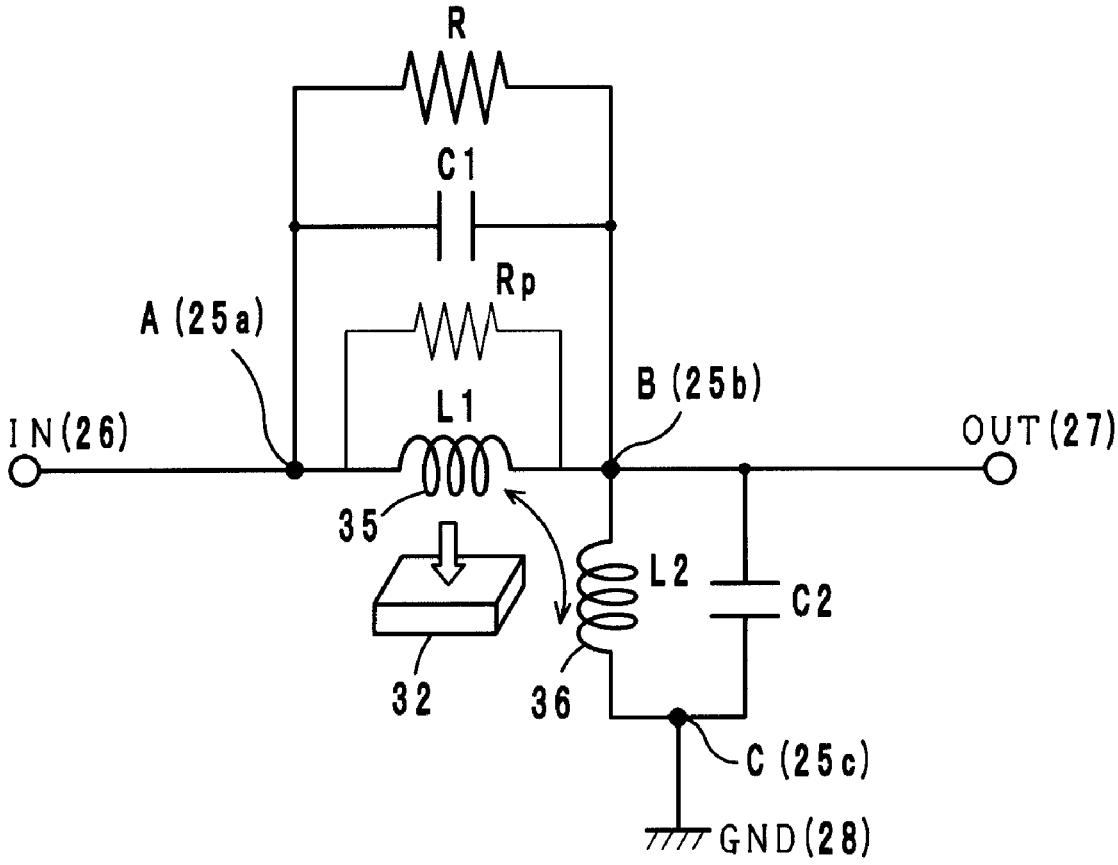
FIG. 5 is an equivalent circuit diagram illustrating a first example of a circuit of the 2-port type isolator.
Figure 6:
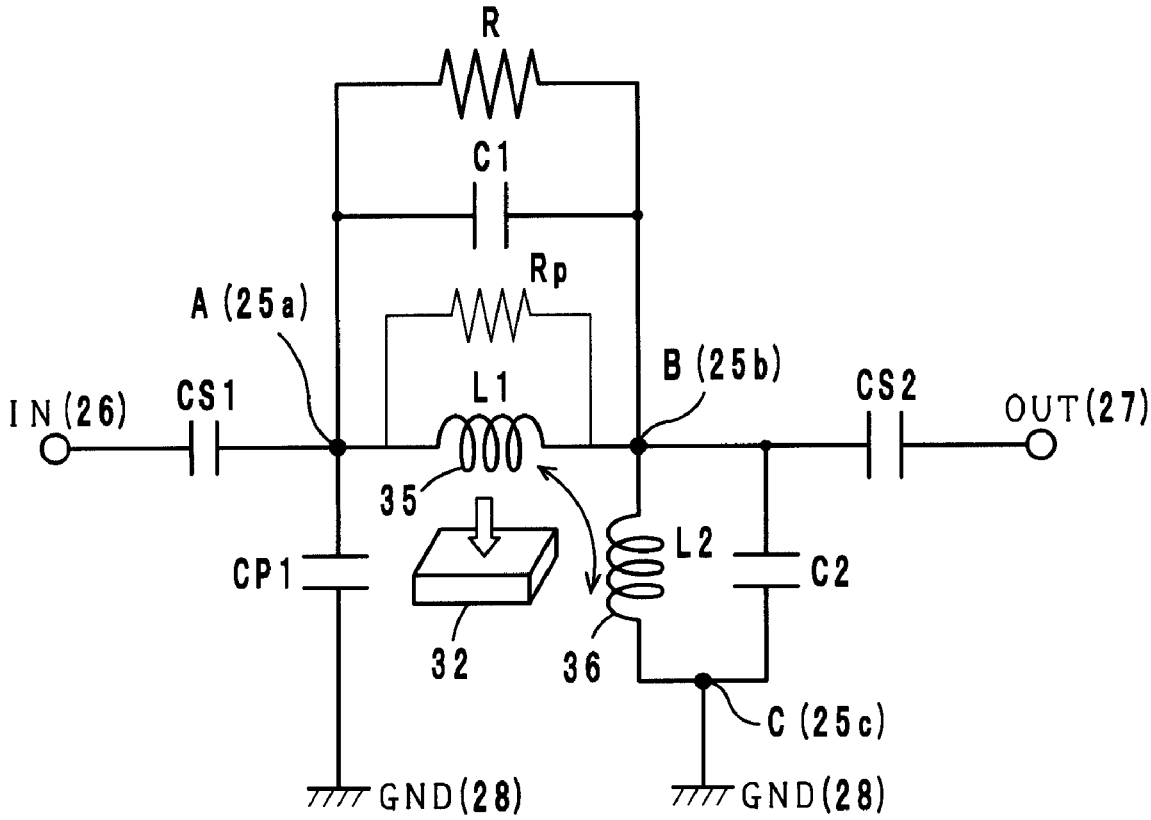
FIG. 6 is an equivalent circuit diagram illustrating a second example of a circuit of the 2-port type isolator.

The circuit board 20 preferably includes a ceramic multi-layered substrate defined by a laminate including a plurality of dielectric ceramic sheet on which an electrode is formed and co-fired. As shown in FIGS. 5 and 6 which illustrate an equivalent circuit and in FIG. 8 which illustrates an internal configuration, matching capacitors C1, C2, CS1, CS2 and CP1 are embedded in the circuit board 20 and a chip-type terminating resistor R (see FIG. 1) is mounted on an outer surface of the circuit board 20. It is noted that FIGS. 5 and 6 show first and second examples of circuit configurations, respectively, and FIG. 8 corresponds to the circuit configuration of FIG. 6. Termination electrodes 25*a* to 25*e* are provided on the top surface and electrodes defining external connections 26, 27 and 28 are provided on the bottom surface (mounting surface).

The ferrite-magnet assembly 30 is arranged on the circuit board 20 so that the connection terminals 35*b*, 35*c* and 36*p* which are arranged at the bottom surface of the ferrite are soldered to 25*a* 25*b* and 25*c* which are provided on the top surface of the circuit board 20 by reflow soldering, for example, to define a single unit with the circuit board, and the bottom surface of the permanent magnet 41 is bonded to the circuit board with an adhesive material.

The tabular yoke 10 functions as an electromagnetic shield and is located directly above the magnet-ferrite assembly 30. As shown in FIG. 1, between the circuit board 20 and the yoke 10, a resin material 11 is provided to surround the ferrite-magnet assembly 30. The terminating resistor is also covered by the resin material 11. The resin material 11 is preferably a compound resin of a silica, a phenol resin and an epoxy resin as main components, for example.

Connections between the matching circuit elements and the first and second central electrodes 35 and 36 are shown in FIG. 5 as a first example and in FIG. 6 as a second example. Here, the second example shown in FIG. 6 is described with referring to FIG. 8.

The external connection electrode 26 which is provided on the bottom surface of the circuit board is connected to the termination electrode 25*a* (input port A) with the matching capacitor CS1 therebetween and is connected to the matching capacitor C1 and the terminating resistor R. The termination electrode 25*a* is connected to a first end of the first central electrode 35 via the connection electrode 35*b* which is provided on the bottom surface of the ferrite 32.

A second end of the first central electrode 35 and a first end of the second central electrode 36 are connected to the terminating resistor R, the capacitor C1, and the capacitor C2 via the connection electrode 35*c* provided on the bottom surface of the ferrite 32 and the termination electrodes 25*b* (output port B) which is provided on the top surface of the circuit board 20, and are connected to the for external connection electrode 27 which is provided on the bottom surface of the circuit board 20 via the capacitor CS2. The terminating resistor R is connected to the termination electrodes 25*d* and 25*e* which are provided on the top surface of the circuit board 20.

A second end of the second central electrode 36 is connected to the capacitor C2 and the external connection electrode 28 which is provided on bottom surface of circuit board 20 via the connection electrode 36*p* provided on the bottom surface of the ferrite 32 and the termination electrodes 25*c* (ground port C) which is provided on the top surface of the circuit board 20. The grounded impedance matching capacitor CP1 is connected at a connection point of the termination electrode for input side 25*a* (input port A) and the capacitor CS1.

Figure 8:
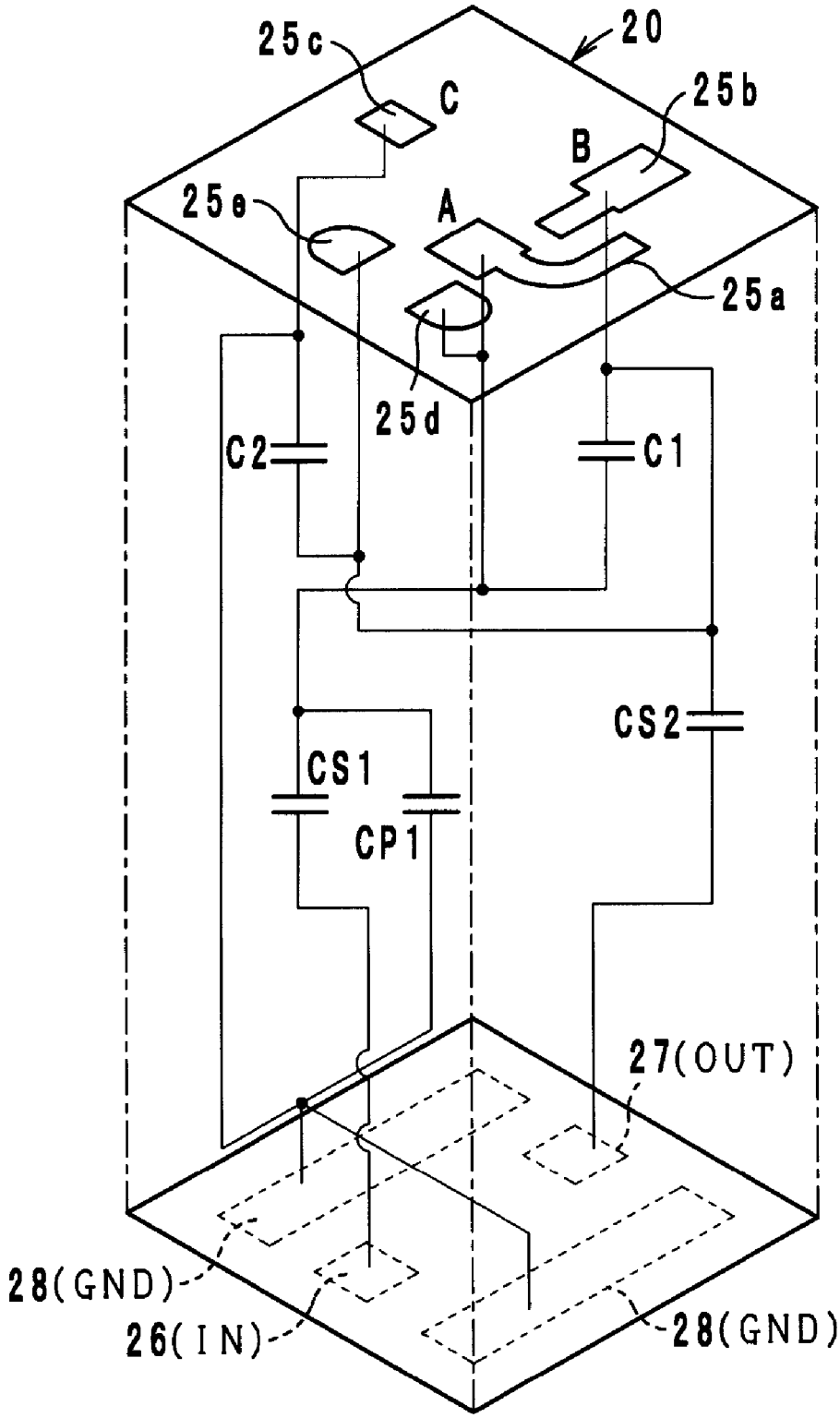
FIG. 8 is a block diagram illustrating the internal configuration of a circuit board of the second circuit example.

A first circuit example shown in FIG. 5 is a basic type in which circuit elements (capacitor CS1, CS2 and CP1) are partially eliminated from the second circuit example shown in FIGS. 6 and 8.

In a 2-port type isolator having above-described configuration, since one end of the first central electrode 35 is connected to the input port A and the other end is connected to the output port B, and one end of the second central electrode 36 is connected to the output port B and the other end is connected to the ground port C, a large high frequency current flows through the second central electrode 36, while almost no high-frequency current flows through the first central electrode 35. Therefore, a 2-port type lumped constant isolator having low insertion loss can be obtained.

Since the second central electrode 36 is wound around the ferrite 32 by at least two turns, the second central electrode 36 has relatively high inductance value and Q value, and an improved isolator is provided as a result.

Figure 7:
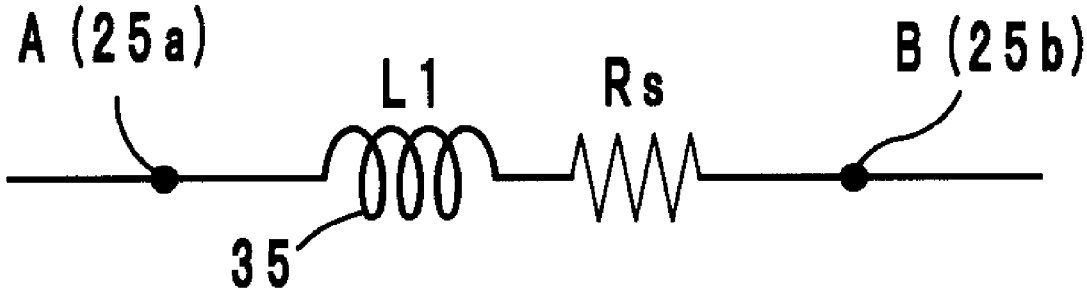
FIG. 7 is an equivalent circuit diagram illustrating a series resistance of the first central electrode.

When high frequency signals flow in the reverse direction from the external connection electrode 27, most of the power is consumed at the terminating resistor R, and the terminating resistor R is overheated accordingly. Therefore, the first preferred embodiment of the present invention is arranged such that a power consumption at the first central electrode 35 is increased, when signals flow in the reverse direction, as compared to a power consumption at the terminating resistor R, by decreasing an equivalent parallel resistance Rp shown in FIGS. 5 and 6. A ratio of the power consumption at the equivalent parallel resistance Rp and the power consumption at the terminating resistor R is inversely proportional to the respective resistance values. The equivalent parallel resistance Rp can be replaced by an equivalent series resistance Rs as shown FIG. 7. Therefore, a decrease in the equivalent parallel resistance Rp corresponds to an increase in the equivalent series resistance Rs.

Specifically, in order to provide the most suitable equivalent parallel resistance Rp, a resistance value per unit length of the first central electrode 35 is selected to be greater than a resistance value per unit length of the second central electrode 36. For example, a width or a thickness of the first central electrode 35 is selected to be less than a width or a thickness of the second central electrode 36, or a surface or edge roughness of the first central electrode 35 is selected to be greater than a surface or edge roughness of the second central electrode 36. Alternatively, an electrical conductivity of the first central electrode 35 is selected to be less than an electrical conductivity of the second central electrode 36. A surface resistance of the first central electrode 35 may be selected to be greater than a surface resistance of the second central electrode 36.

Figure 4:
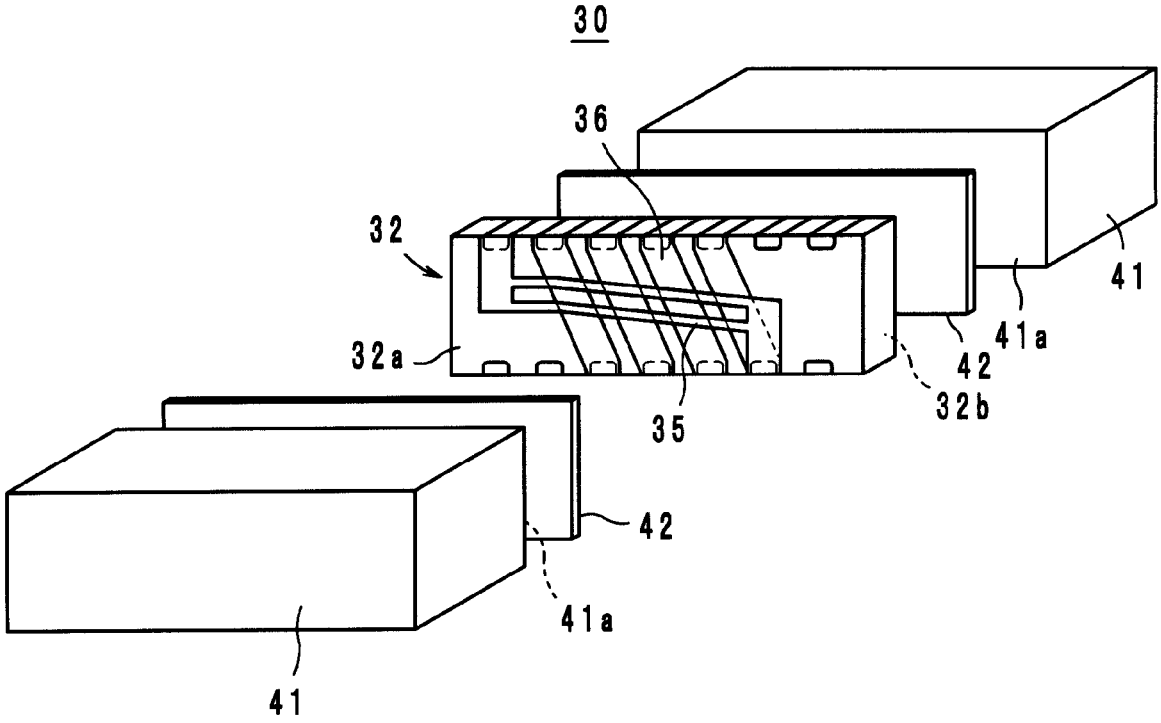
FIG. 4 is an exploded perspective view illustrating the ferrite-magnet assembly.

In other words, an inductance value and a Q value of the second central electrode 36 are preferably relatively high and a Q value of the first central electrode 35 is preferably relatively low. Specifically, the Q value of the second central electrode 36 is preferably in the range of about 50 to about 180, for example, and the Q value of the first central electrode 35 is preferably in the range of about 50 to about 80. Although the Q value of the first central electrode 35 is relatively low as a result, electrical qualities, such as insertion loss and isolation, are not deteriorated. The resistance value of the terminating resistor R is selected such that the isolation is maximized. In the first preferred embodiment of the present invention, as shown in FIG. 4, the first central electrode 35 is bifurcated and a width thereof is relatively narrow so as to have a low Q value.

The equivalent parallel resistance Rp of the second central electrode 36 is set at maximum value within an acceptable range so that the Q value attains a maximum value. As a result, the insertion loss of the isolator can be minimized.

Figure 9:
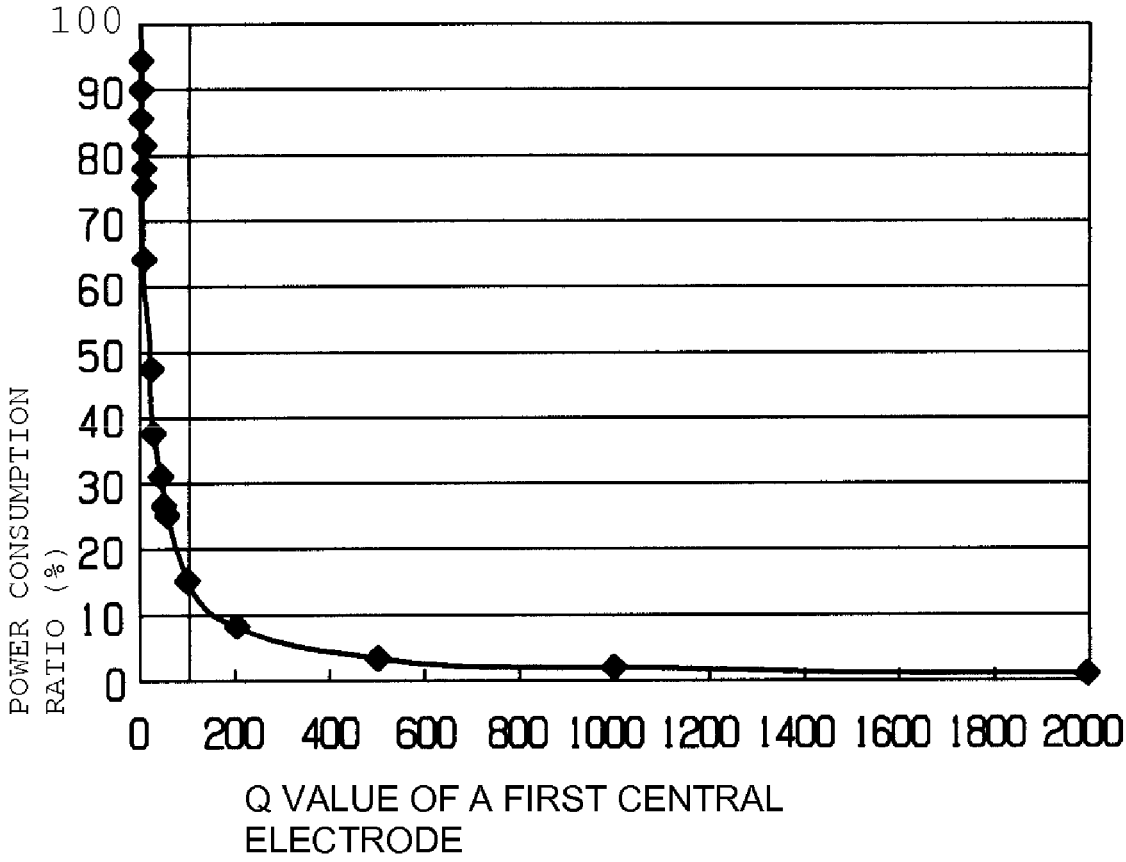
FIG. 9 is a graph that shows the relationship of a Q value of the first central electrode and a power consumption ratio, which is the power consumed at the first central electrode versus the power consumed at terminating resistor R.

FIG. 9 shows the relationship of the Q value of the first central electrode 35 and a power consumption ratio, which is the power consumed at the first central electrode 35 versus the power consumed at terminating resistor R when the power is input in the reverse direction. When the Q value of the first central electrode 35 is greater than about 100, the power consumption ratio at the equivalent parallel resistance Rp is relatively small, and the power handling capability is relatively small. When the Q value of the first central electrode 35 is less than or equal to about 100, the power consumption ratio at the equivalent parallel resistance Rp drastically increases. That is, when the Q value is about 100 the power consumption ratio at the equivalent parallel resistance Rp becomes about 15.3%, and when the Q value is about 50 the ratio becomes about 26.5%. However, when the Q value of the first central electrode 35 is less than or equal to about 20, the isolation band is decreased, and such the Q value is not satisfactory.

As described above, while most of the power flowing into an isolator in the reverse direction is conventionally consumed at the terminating resistor R, in the first preferred embodiment of the present invention, a portion of the power in the reverse direction is consumed at the first central electrode 35, such that the heat generated thereby is dispersed. The dispersion of heat significantly improves the power handling capability of the isolator. In addition, failures such as a burnout of the terminating resistor can be prevented so as to improve the reliability of the isolator. Furthermore, since a smaller terminating resistor can be used, the size of the isolator can be reduced. Since a thermal resistance is decreased by an increased heat radiation path, adequate heat radiation is provided even if a smaller profile isolator is provided.

A resistance value of the terminating resistor R has a specific temperature characteristic and changes with changes in temperature. If the resistance value is changed from a specified range, isolation is decreased. In addition, the resistance of the terminating resistor R increases with repeated exposure to high temperatures, and therefore isolation is decreased. In the first preferred embodiment of the present invention, since the heat generation at the terminating resistor R is decreased by the dispersion of the generated heat, communication devices that include such an isolator do not cause a decrease in isolation during operation, are less influenced by the operating conditions, and exhibit stable electrical characteristics for a prolonged period of time.

Circuit parameters for a second preferred embodiment of the present invention shown in FIG. 6 are set forth below.

First central electrode 35: Inductance about 1.7 nH, Q value about 50

Second central electrode 36: Inductance about 22 nH, Q value about 120

Capacitor C1: about 4 pF

This capacitor determines the isolation frequency. Capacitance maximizing isolation in the operating frequency is preferred.

Capacitor C2: about 0.3 pF

This capacitor determines communication frequency. Capacitance minimizing insertion loss in the operating frequency is preferred.

Capacitor CS1: about 2.5 pF

This capacitor sets the isolator matching with characteristic impedance of about 50Ω. Capacitance minimizing insertion loss in the operating frequency is preferred.

Capacitor CS2: about 3.5 pF

This capacitor sets the isolator matching with characteristic impedance about 50Ω. Capacitance minimizing insertion loss in the operating frequency is preferred.

Terminating resistor R: about 390 Ω

This resistor defines a terminating resistor that absorbs a reverse direction power. Resistance maximizing isolation in the operating frequency is preferred.

Capacitor CP1: about 0.05 pF

This capacitor sets the isolator matching with characteristic impedance about 50Ω. Capacitance maximizing return loss of input and minimizing insertion loss in the operating frequency is preferred.

Figure 10:
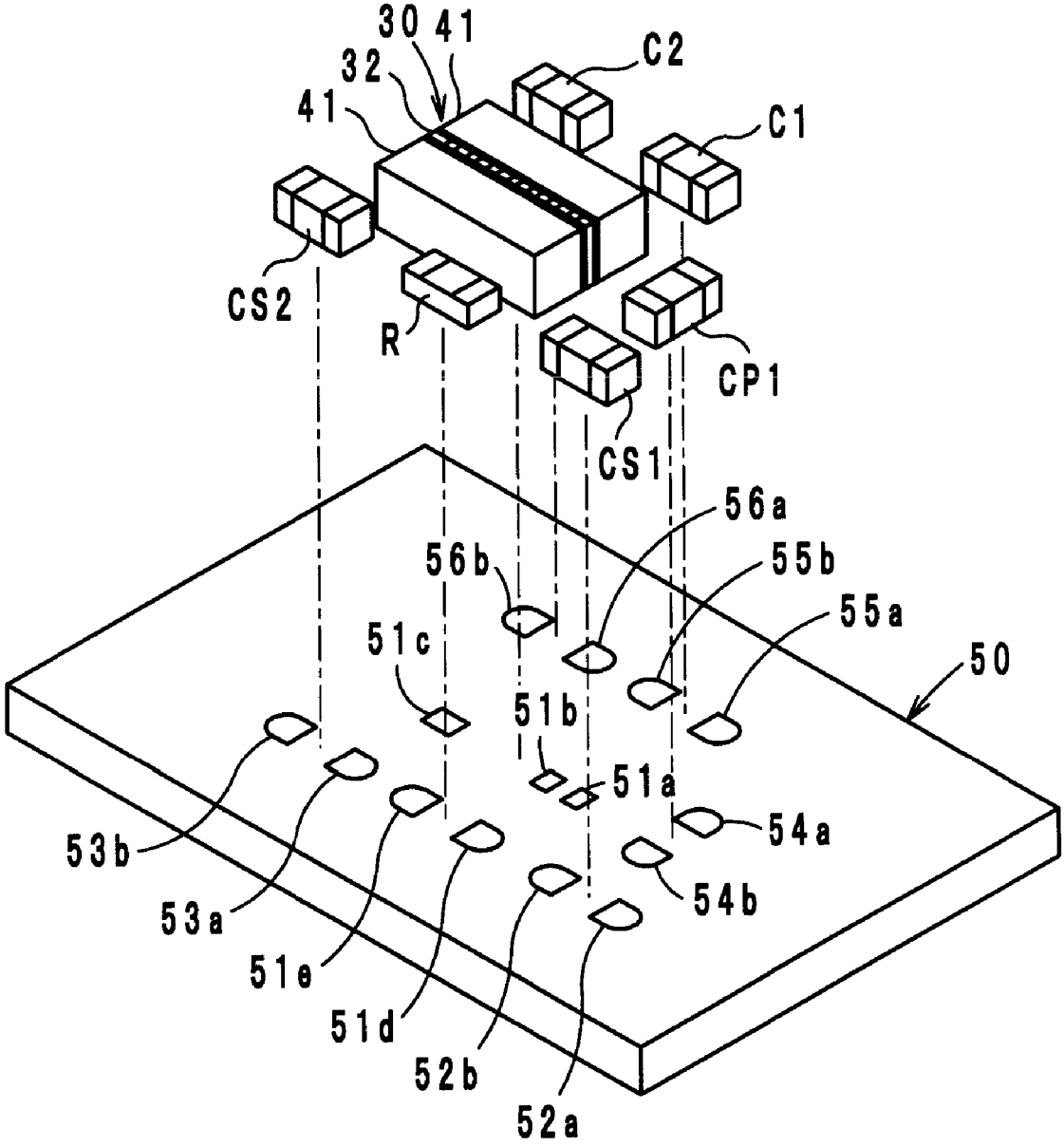
FIG. 10 is an exploded perspective view illustrating a non-reciprocal circuit device according to a second preferred embodiment of the present invention.

As shown in FIG. 10, the isolator according to the second preferred embodiment of the present invention includes a ferrite-magnet assembly 30 in a module profile, a terminating resistor R, capacitors C1, C2, CS1, CS2 and CP1 are mounted by soldering on termination electrodes 51*a*, 51*b*, 51*c*, 51*d*, 51*e*, 52*a*, 52*b*, 53*a*, 53*b*, 54*a*, 54*b*, 55*a*, 55*b*, 56*a* and 56*b* which are provided on a circuit board 50 for a communication equipment. The circuit diagram is as shown in FIG. 6 and a relationship of the connection in the circuit board 50 is substantially the same as shown in FIG. 8.

In the second preferred embodiment of the present invention, similar to the first preferred embodiment of the present invention described above, a power consumption at the first central electrode 35 is increased by decreasing an equivalent parallel resistance Rp of the first central electrode 35, as compared to the power consumption at the terminating resistor R, when high frequency signals flow in the reverse direction. Accordingly, the operation and the advantages are substantially the same as in the first preferred embodiment of the present invention.

The present invention is not limited to the above described preferred embodiments, and the non-reciprocal circuit devices of the present invention can be modified in various ways within the scope of the present invention.

For example, by inverting the N pole and the S pole of the permanent magnet, the input port and the output port are switched. The configuration of a matching circuit is not specifically limited and circuit configurations other than those shown in FIG. 5 and FIG. 6 may be used. The configuration of the first and second central electrodes and the winding turns for the ferrite are not specifically limited.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit device comprising:

a permanent magnet;

a ferrite arranged to receive a direct-current magnetic field from the permanent magnet;

a first central electrode and a second central electrode arranged on the ferrite so as to cross each other and so as to be electrically insulated from each other, a first end of the first central electrode is electrically connected to an input port and a second end of the first central electrode is electrically connected to an output port, a first end of the second central electrode is electrically connected to the output port and a second end of the second central electrode is electrically connected to a ground port;

a first matching capacitor electrically connected between the input port and the output port;

a second matching capacitor electrically connected between the output port and the ground port;

a terminating resistor electrically connected between the input port and the output port; wherein the non-reciprocal device is arranged to allow high frequency signals to easily flow in a forward direction but not to easily flow in a reverse direction;

characteristics of the terminating resistor and the first central electrode are set such that when high frequency signals flow in the reverse direction, power consumption at the first central electrode is increased due to a decreased equivalent parallel resistance of the first central electrode in relation to a power consumption at the terminating resistor.

2. The non-reciprocal circuit device according to claim 1, wherein the second central electrode is wound around the ferrite at least two turns.

3. The non-reciprocal circuit device according to claim 1, wherein the Q value of the first central electrode is less than the Q value of the second central electrode.

4. The non-reciprocal circuit device according to claim 1, wherein the Q value of the first central electrode is in a range of about 20 to about 100.

5. The non-reciprocal circuit device according to claim 1, wherein the Q value of the first central electrode is in a range of about 50 to about 80 and the Q value of the second central electrode is in a range of about 50 to about 180.

6. The non-reciprocal circuit device according to claim 1, wherein when high frequency signals flow in the reverse direction, the power consumption at the first central electrode is increased due to a resistance value per unit length of the first central electrode being greater than a resistance value per unit length of the second central electrode.

7. The non-reciprocal circuit device according to claim 6, wherein a width or a thickness of the first central electrode is less than a width or a thickness of the second central electrode.

8. The non-reciprocal circuit device according to claim 6, wherein a surface or edge roughness of the first central electrode is greater than a surface or edge roughness of the second central electrode.

9. The non-reciprocal circuit device according to claim 6, wherein an electrical conductivity of the first central electrode is less than an electrical conductivity of the second central electrode.

10. The non-reciprocal circuit device according to claim 6, wherein a surface resistance of the first central electrode is greater than a surface resistance of the second central electrode.

* * * * *